US007193371B2

(12) United States Patent
Huber et al.

(10) Patent No.: US 7,193,371 B2
(45) Date of Patent: Mar. 20, 2007

(54) ELECTRONIC BALLAST HAVING TIMING UNIT CORRECTION

(75) Inventors: Andreas Huber, Traunreut (DE); Wolfgang Langgabner, Bad Aibling (DE); Shokrollah Norali-Ghasemi, Traunwalchen (DE); Axel Pilz, Neuenstein (DE)

(73) Assignee: Patent-Treuhand-Gesellschaft fur Elektrisch Gluhlampen mbH (DE)

( * ) Notice: Subject to any disclaimer, the term of this patent is extended or adjusted under 35 U.S.C. 154(b) by 101 days.

(21) Appl. No.: 11/046,702

(22) Filed: Feb. 1, 2005

(65) Prior Publication Data

US 2005/0174067 A1 Aug. 11, 2005

(30) Foreign Application Priority Data

Feb. 6, 2004 (DE) ..... 10 2004 006 123

(51) Int. Cl.
*H05B 37/02* (2006.01)

(52) U.S. Cl. ..... 315/224; 315/307

(58) Field of Classification Search ..... 315/247, 315/291, 224, 308, 307
See application file for complete search history.

(56) References Cited

U.S. PATENT DOCUMENTS

| | | | | |
|---|---|---|---|---|
| 4,823,328 | A * | 4/1989 | Conklin et al. | 368/47 |
| 5,519,289 | A | 5/1996 | Katyl et al. | 315/224 |
| 6,567,487 | B1 | 5/2003 | Pilz | 375/360 |
| 6,570,343 | B1 * | 5/2003 | Shoji et al. | 315/224 |
| 6,774,768 | B2 * | 8/2004 | Flory, IV | 340/309.16 |
| 6,801,003 | B2 * | 10/2004 | Schanberger et al. | 315/291 |
| 6,956,336 | B2 * | 10/2005 | Ribarich | 315/247 |
| 2003/0210000 | A1 | 11/2003 | Erhardt | 315/307 |

FOREIGN PATENT DOCUMENTS

| | | | |
|---|---|---|---|
| EP | 0 681 413 | A2 | 11/1995 |
| ES | 2 153 314 | A1 | 2/2001 |
| JP | 2001 015276 | A | 1/2001 |
| JP | 2001 15276 | A * | 1/2001 |

OTHER PUBLICATIONS

European Patent Office Search Report (dated Jun. 15, 2005; 3 pages total) for related European Patent Application No. 05 00 0613.

* cited by examiner

*Primary Examiner*—Trinh Vo Dinh
(74) *Attorney, Agent, or Firm*—Fitch, Even, Tabin & Flannery

(57) ABSTRACT

The invention relates to an operating method and an electronic ballast (EVG) for operating a light-producing apparatus (L), for example a discharge lamp. In this case, an internal timing unit in the ballast (EVG) is corrected with the aid of time information ($T_M$) received in external signals.

11 Claims, 2 Drawing Sheets

ELECTRONIC BALLAST HAVING TIMING UNIT CORRECTION

TECHNICAL FIELD

The present invention relates to a method for operating a light-producing apparatus, in particular a lamp.

BACKGROUND ART

It is known per se, for operating lamps, in particular discharge lamps, or other light-producing apparatuses such as LEDs, to use electronic ballasts. This term in this case means a wide variety of electronic operating devices, and in particular those which use, for example, an inverter to produce a supply voltage, which is matched in terms of voltage, frequency and/or other relevant parameters, from a supply voltage of the ballast for the light-producing apparatus. One important application is electronic ballasts having inverters which operate discharge lamps primarily, but not exclusively, low-pressure discharge lamps. Such electronic ballasts are in many cases equipped with controllers which require an internal timing unit in the ballast. In particular, the operating frequency of a discharge lamp can be derived from the signal from the internal timing unit.

DISCLOSURE OF THE INVENTION

The invention is based on the technical problem of specifying an improved operating method and an improved electronic ballast in which an internal timing unit is used.

The invention relates to a method for operating a light-producing apparatus, in which the light-producing apparatus is operated using an electronic ballast which has an internal timing unit for internal timing purposes, an external signal, which contains time information, is received by the electronic ballast, the internal timing is corrected with the aid of the time information, and operating functions of the light-producing apparatus are controlled with the aid of the timing, and to a correspondingly designed electronic ballast which has an internal timing unit for controlling operating functions of the light-producing apparatus and a time correction device.

Preferred refinements of the invention are specified in the dependent claims and are explained below. In this case, no more details on the differences between the nature of the method and the nature of the apparatus of the invention are given. The features are in each case essential to both aspects of the invention and are to be regarded as disclosed for both claim categories.

The invention is based on the fact that the internal timing in the ballast is corrected with the aid of time information which has been received in an external signal. This was based on the observation by the inventors that when there is a combination of electronic ballasts with other technical devices, for example other ballasts or sensors or control devices, problems with inaccurate internal timing units may result. This concerns, for example, the evaluation of signals relative to a reference time or reference frequency, time-controlled operation of two or more ballasts with one another and other situations.

However, instead of replacing the internal timing unit in the ballast with a central timing unit, i.e. instead of in principle using external signals to carry out the time clocking within the ballast, the inventors propose that an internal timing unit still be used, but to carry out corrections. The ballast thus retains a certain independence and can also be operated fully independently of other devices. On the other hand, there is no need to use technically more complex, more expensive and more accurate timing units, for example crystal or ceramic oscillators, or to carry out complex individual compensation of oscillators during production in order to avoid component scatter. However, such measures requiring accuracy are not ruled out with the invention. Rather, the invention allows for such measures only to be omitted in individual cases, since they decrease the dependence on the accuracy of the internal timing unit.

Correction by calculating and storing a correction value is preferred. In this case, the oscillator, on which the internal timing unit is based, will continue to run unchanged per se. The invention of course has other solutions by means of which this oscillator is changed, i.e. corrected or tuned. However, the abovementioned, preferred solution using correction values is in many cases more pragmatic and simpler and at the same time equally effective.

The external signal may be a control signal, to be precise preferably a digital control signal, by means of which a control device drives the electronic ballast as part of an illumination system. In particular, control signals based on the so-called DALI protocol or else digital control signals of other communications protocols also come into consideration.

The time information can be digitally encoded in such digital control signals, but is preferably contained in the digital data rate, i.e. the bit frequency or comparable parameters. The time information is preferably determined from the time interval between pulse edges, to be precise in a particularly preferred manner between first pulse edges of a digital word (byte). For example, the time information can be obtained using the time interval between the first equidirectional, i.e. the first falling or the first rising, edges of a byte. First edges can of course also be the first inverse edges. In some cases, depending on the value of the bit(s) associated with these edges, a correction needs to be taken into account, since the time interval can depend on the bit value. Reference is made to the exemplary embodiment and to the correction therein by a factor of 1.5.

The external signal, which contains the time information, may in addition originate from a sensor. In this case, it may likewise be a digital signal or else a digital signal within the DALI protocol. However, analog signals also come into consideration. In particular, in this case applications apart from illumination systems controlled by control devices also come into consideration, for example when individual or a small number of ballasts communicate with a sensor without forming together an illumination system in the sense of a common controller. The sensor may in particular be a light value sensor which provides information to the ballast on the brightness of a region which is illuminated or is to be illuminated. In this case, the ballast may be designed such that the lamp brightness is controlled or regulated with the aid of an automatic dimmer function depending on the light information provided by the sensor.

Frequency coding is preferably present in the external signal provided by the sensor, and thus, for example, the information on the light value is expressed by the frequency of the signal or a frequency within the signal.

The sensor may also be, instead of a light value sensor or in addition to a light value sensor, a movement sensor whose signal is used to switch the light-producing apparatus, in particular a lamp, on and off.

Moreover, in addition to the frequency coding or instead of the frequency coding, duration coding in the sense of coding over the duration of specific signal components or pulse trains may be present in the sensor signal. Particularly preferred is a combination of light value sensor and movement sensor in which the light value information having frequency coding and, in contrast thereto, movement sensor signals having a fixed frequency but a specific minimum time duration are transmitted. Reference is made to the exemplary embodiment.

It has already been mentioned that the electronic ballast preferably has a dimmer function, for example a dimmer function which can be operated automatically using a light sensor signal. With the invention it is also preferred for the dimmer function to be controllable via a control input of the electronic ballast, to be precise in particular by supply voltage pulses being applied to the control input. Preferred in this case is the fact that relatively short pulses (in duration coding) mean switch-on and switch-off commands and relatively long pulses mean dim commands, depending on their length.

In the case of the various types of coding mentioned, i.e. the frequency coding or duration coding, the signals from the internal timing unit are used for evaluation purposes and the invention can improve the described functions owing to the correction. This correction may also take place by the timing unit signals being used unchanged for evaluation or control purposes, but the corresponding correction values only being taken into account during evaluation or control itself in the circuit elements of the electronic ballast which are responsible for this evaluation or control. There may thus be embodiments in which the oscillator signal itself or purely temporal signals derived therefrom are not corrected but the correction is only undertaken when the time information is used for control or evaluation purposes. The term "timing" is in this sense not to be regarded as being restricted to the oscillator and any downstream timers, but also includes the components in which the time information is used for evaluation or control purposes. However, correction of the timing unit (including derived timers) is preferred.

Since the invention proposes correction possibilities, it is preferred to use simple and inexpensive internal timing units, i.e. in particular those which contain simple RC oscillators. These may also be on-chip oscillators, i.e. oscillators integrated in a control circuit, for example a microcontroller.

BRIEF DESCRIPTION OF THE DRAWINGS

The invention will be explained in more detail below with reference to an exemplary embodiment, it being possible for the individual features to also be in other combinations in a manner which is essential to the invention.

In detail, in the drawings.

BEST MODE FOR CARRYING OUT THE INVENTION

Figure 1:
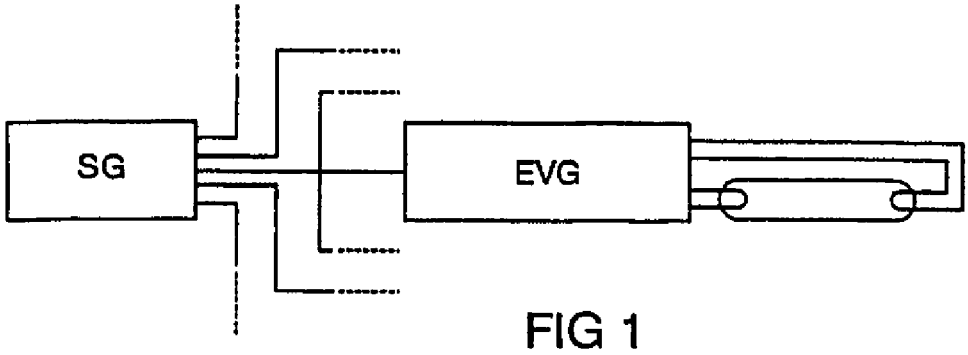
FIG. 1 shows a schematic diagram of an illumination system having a ballast according to the invention.

FIG. 1 shows a schematic illustration of an illumination system comprising a large number of electronic ballasts and connected lamps and partially, in some cases, also lamps operated without ballasts and sensors. In this figure, SG indicates a central, digital control device and EVG indicates one of the ballasts which is a ballast according to the invention. A low-pressure discharge lamp which is operated by the electronic ballast EVG is given the designation L. The remaining lines passed out of the control device SG are intended to symbolize the large number of remaining elements in the illumination system.

Figure 3:
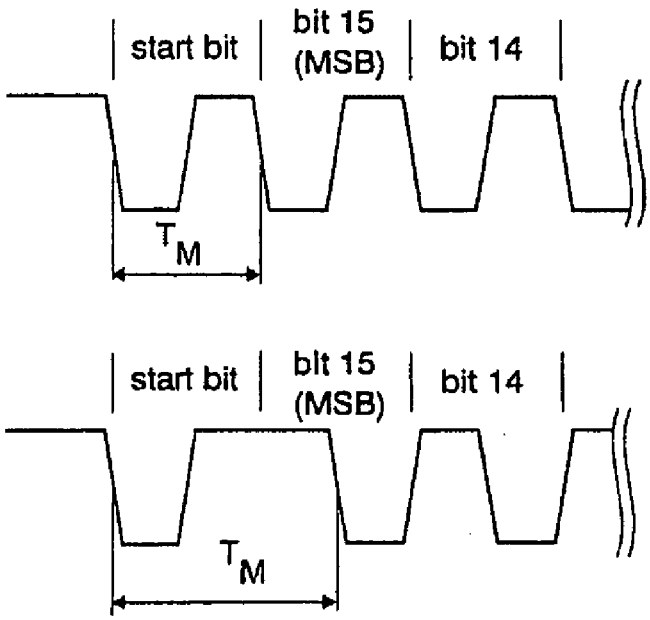
FIG. 3 shows a schematic illustration of digital signals in the illumination system shown in FIG. 1.

The control device SG controls the ballast EVG using digital control signals based on the DALI protocol which are illustrated schematically in FIG. 3. Here, in each case the start of a first upper and a second lower signal is illustrated. These are so-called biphase-encoded signals. This means that the logic 1 and the logic 0 do not correspond to the electrical low level or high level or vice versa but to a predetermined level change. For example, a rising level step change means a logic 0 and a falling level step change means a logic 1. This has the advantage that the presence of a bit can clearly be identified. For explanations, reference is made to EP 1 069 690.

FIG. 3 shows the start of a word (frame), a left-hand, first start bit having a rising edge, i.e. logic 0, being illustrated. Following on from this is a most significant bit No. 15 and further bits having the numbers 14–0, of which only the bit No. 14 is illustrated. Even the bit No. 15 can assume different values, as is shown by the two word starts illustrated one above the other in FIG. 3.

The ballast EVG uses the time interval between the first two falling edges, which is given the designation TM in the figure, as time information. It can be seen that this time interval in the lower case is one and a half times as long as in the upper case and the upper time interval corresponds to the bit rate.

Figure 4:
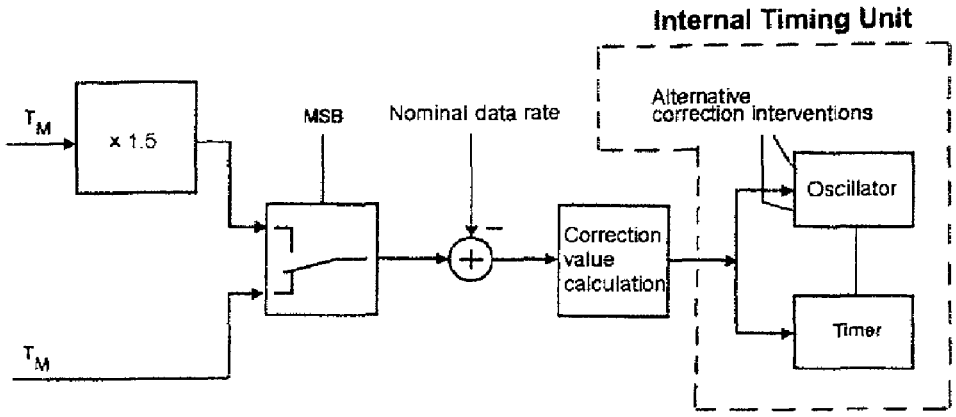
FIG. 4 shows a flow chart for explaining the sequence of the method according to the invention in the ballast from FIG. 1.

FIG. 4 illustrates, using a flow chart, the functional sequence within the ballast EVG from FIG. 1. The time $T_M$ determined is received via two signal paths, of which one carries out a multiplication by a factor of 1.5. As a function of the value of the most significant bit (MSB) No. 15, switching takes place to and fro between these two signal paths, with the result that in each case the 1.5 times bit rate is present downstream of the symbolic switch given the designation MSB. The time $T_M$ is measured with the aid of the internal timing unit in the ballast EVG and therefore carries its errors. The 1.5 times bit rate is compared with a nominal data rate stored in the ballast EVG, and a correction value is calculated from this. The right-hand region of FIG. 4 illustrates the fact that this correction value can alternatively be fed to the oscillator of the timing unit itself in order to correct said timing unit, or can be given to internal timers, supplied by the oscillator, in the timing unit. In the exemplary embodiment, the lower variant is carried out, i.e. the oscillator in the ballast EVG continues to run uncorrected. In both cases, the bit rate acts as a time reference for the timing within the EVG.

Figure 2:
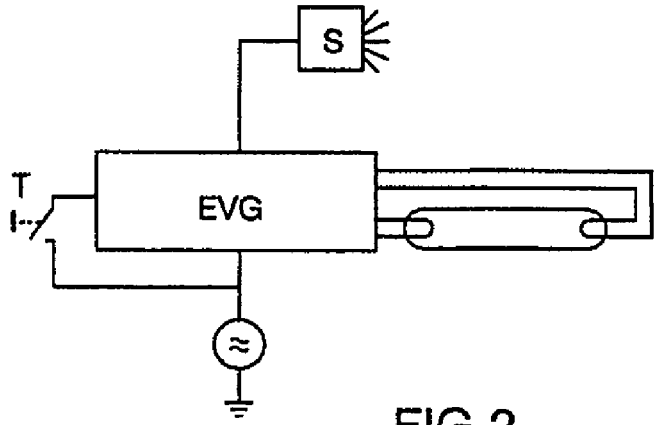
FIG. 2 shows a schematic diagram of a ballast according to the invention which is used with a sensor.

A second example is shown in FIG. 2. Here, the same ballast EVG is used as in FIG. 1 but in a different way. It is used in an individual luminaire having a lamp L and a light sensor S. The ballast EVG is supplied, as illustrated symbolically below, with a supply voltage, for example the conventional domestic power supply voltage. This is supplied via a button T to a further control input of the ballast EVG.

The light sensor S has both a function as a light value sensor for detecting the brightness of an area illuminated by the lamp L and the function of a movement sensor for detecting movements in this area. If the luminaire is fundamentally switched on, the ballast EVG switches the lamp L on or off as a function of whether a movement is detected in the area covered by the light sensor S and is signaled or whether, for a time which can be set, for example 15 min, no movement has been signaled. It is thus possible to achieve, on the one hand, a situation in which the luminaire switches itself on automatically when there is a person walking in the area, and, on the other hand, it is possible to prevent the luminaire being operated unnecessarily and thus power being consumed when the area is not in use.

Furthermore, the light sensor S detects the brightness of the illuminated area which can vary depending on the use of further luminaires or else depending on the daylight irradiation. As a result, a dimmer function of the ballast EVG can automatically adapt the power of the lamp L, i.e. in particular reduce the lamp power when the daylight irradiation increases over the course of the morning, and step it up again when the daylight irradiation decreases over the course of late afternoon and evening.

In addition, the mentioned control input of the ballast EVG can be used via the button T. A short touch of the button means a manual switch-on or switch-off command. A longer touch of the button allows the ballast EVG to cyclically brighten the lamp L and to dim it down again once the maximum power has been reached and to brighten it again once the minimum dimming power has been reached. The user can thus manually set a desired lamp power by retaining pressure on the button T, and this lamp power is then adjusted depending on the further light value information from the light sensor S.

Figure 5:
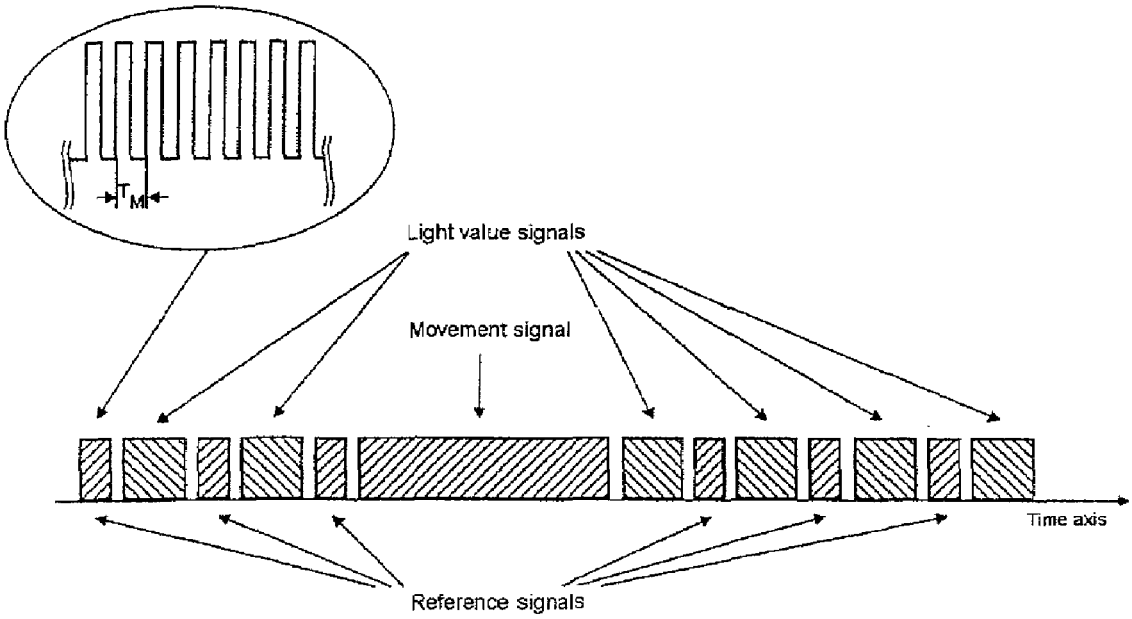
FIG. 5 shows a schematic illustration of a signal from the sensor shown in FIG. 2.
Figure 6:
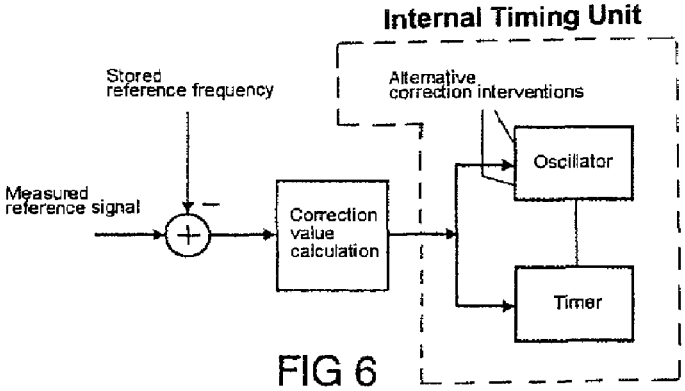
FIG. 6 shows a flow chart for explaining the method according to the invention in the ballast from FIG. 2.

FIG. 5 shows a schematic illustration of a signal transmitted from the light sensor S to the ballast EVG on the time axis. In this case, the individual blocks, as are shown in the sectional illustration in the upper region, represent a respective sequence of individual pulses. In this case, coding over the duration takes place at the same time as coding over the frequency of the signals. The relatively short blocks are transmitted at constant intervals and form as a result of the respectively present pulse frequency within the blocks a reference signal in the sense of the time correction. The same nominal duration $T_M$ is thus tapped off as is explained with reference to FIGS. 3 and 4, and is used for correction purposes in the same manner as explained with reference to FIG. 4, but without the distinction between different bit states. This is illustrated in FIG. 6.

When it has perceived a movement, the light sensor S interrupts this sequence of regular reference signals by means of a movement signal. This signal is illustrated in the center in FIG. 5 and differs from the reference signals in that it exceeds a specific minimum value. A movement signal leads to, as already mentioned, the operation of the lamp L being switched on or being maintained.

Slightly longer lasting light value signal blocks are illustrated between the already mentioned reference signal blocks and in principle have the same design as the movement signal. However, they have a different frequency. The difference between the frequency of the light value signals and the fixed frequency of the reference signals and the movement signals represents the detected light value and leads, in the ballast EVG, to the dimmer function being evaluated and driven in a manner which is not described in detail here.

With the aid of the invention, a simple on-chip RC oscillator can be used in the electronic ballast EVG without disadvantages arising from its lack of accuracy. In particular, the illumination system shown in FIG. 1 prevents the scatter between different oscillators in different electronic ballasts from resulting in operational deviations. If, for example, parallel dimming of different lamps is carried out over a constant time through a specific DALI command, typical tolerances of approximately ±4% lead to, for example, deviations between a dimming time of 16.6 s with one ballast and 15.4 s with another ballast. This difference of 1.2 s can clearly be seen and disrupts the actually intended degree of parallelism of the dimming operations. The same applies of course to deviations occurring on account of time shifts, temperature drift and the like.

In the application shown in FIG. 2, in addition to the present explanation corresponding inaccuracies could in turn result in regulation problems. If, for example, a thermal drift of the oscillator in the ballast EVG leads to a change in the reference frequency for the evaluation of the light value information when said ballast EVG is increasingly heated during operation, the ballast EVG will activate the dimmer function in response to this. The temperature drift of the oscillator frequency would thus without the invention result in a change in the total luminous intensity in the area or in a temperature drift-dependent drift of the lamp power. If two or more ballasts were to be provided in the area, other ballasts would for their part be adjusted as a result of the total luminous intensity now drifting in the area, so that an overall unstable regulation situation could result.

What is claimed is:

1. A method for operating a light-producing apparatus, the method comprising the steps of:

providing an electronic ballast for powering the light-producing apparatus, the electronic ballast including an internal timing unit that includes an oscillator, the internal timing unit providing an internal timing function;

receiving, by the electronic ballast, an external signal that contains time information;

processing the time information of the external signal to correct the internal timing function of the electronic ballast, wherein the internal timing function of the electronic ballast is corrected by calculating and storing a correction value in dependence on the time information contained in the external signal, wherein operation of the oscillator is unaffected by the correction value; and controlling the light-producing apparatus in accordance with the correction value.

2. The method as claimed in claim 1, wherein the external signal is a digital control signal of a control device driving the electronic ballast in an illumination system.

3. The method as claimed in claim 2, wherein the time information is determined from a data rate of the digital control signal.

4. The method as claimed in claim 3, wherein the time information is determined from a time interval between first pulse edges of the digital control signal.

5. The method as claimed in claim 4, wherein the time information is determined from an interval between a first two equidirectional pulse edges of the digital control signal, and a correction factor is taken into account depending on a bit value associated with the pulse edges.

6. The method as claimed in claim 1, wherein the external signal is supplied by a sensor.

7. The method as claimed in claim 6, wherein the sensor is a light value sensor which detects a brightness of a region which is illuminated by the light-producing apparatus.

8. The method as claimed in claim 6, wherein the external signal is frequency-encoded.

9. The method as claimed in claim 6, wherein the sensor is a movement sensor whose signal leads to the light-producing apparatus being switched on.

10. The method as claimed in claim 6, wherein the external signal is duration-encoded.

11. The method as claimed in claim 1, wherein the light-producing apparatus is a discharge lamp.

* * * * *